US006187257B1

(12) United States Patent
Heine et al.

(10) Patent No.: US 6,187,257 B1
(45) Date of Patent: Feb. 13, 2001

(54) DROSS REMOVAL ON COATING LINES

(75) Inventors: Hans G. Heine, San Mateo, FL (US); Oleg S. Fishman, Maple Glen, PA (US)

(73) Assignee: Inductotherm Corp., Rancocas, NJ (US)

( * ) Notice: Under 35 U.S.C. 154(b), the term of this patent shall be extended for 0 days.

(21) Appl. No.: 09/126,177

(22) Filed: Jul. 30, 1998

(51) Int. Cl.[7] ..... C22B 7/04
(52) U.S. Cl. ..... 266/44; 266/205; 266/227
(58) Field of Search ..... 266/44, 205, 227

(56) References Cited

FOREIGN PATENT DOCUMENTS

2115347 * 7/1972 (FR) .

OTHER PUBLICATIONS

Derwent Abstract 1998—201804 of Japanese JP10053850A, Feb. 1998.*
Derwent Abstract 1999—136940 of Japanese JP11006046A, Jan. 1999.*

* cited by examiner

*Primary Examiner*—Scott Kastler
(74) *Attorney, Agent, or Firm*—Seidel, Gonda, Lavorgna & Monaco, PC

(57) ABSTRACT

The invention presents an apparatus and method for dross removal from coating lines. The invention utilizes magnets to collect dross either in suspension or which has accumulated at or near the bottom of a coating pot. The invention utilizes the magnetic properties of the dross to separate the dross from the non-magnetic coating metal. The use of magnets allows for removal of dross from the coating metal without simultaneously removing valuable coating metal from the coating pot.

14 Claims, 5 Drawing Sheets

DROSS REMOVAL ON COATING LINES

FIELD OF THE INVENTION

The present invention is directed to a dross removal system for removing bottom dross from a coating line. Specifically, the invention relates to a dross removal system which utilizes magnetic elements to attract magnetic dross within a molten material in order to remove the dross from the material.

BACKGROUND OF THE INVENTION

In coating applications coating lines are used to generate a molten material which is maintained in a coating pot. The molten coating material is typically zinc. In these coating lines, specifically galvanizing lines, a material known as bottom dross is often created. The dross is generated from iron placed into the coating pots wherein iron combines with the zinc to create dross. The specific weight of the alloy is approximately 10% greater than the molten zinc and therefore settles to the bottom of the coating pot or accumulates as a suspension near the bottom of the coating pot. In order to produce quality galvanized material it is necessary to periodically remove the bottom dross.

Conventional methods of removing the dross include scooping out the dross manually or using mechanical devices. While the percentage of dross present in the coating pot relative to the amount of coating zinc is small, use of the known removal devices tends to remove large amounts of the molten zinc along with the dross. The removal of the zinc results in decreased efficiency and higher expenses because of loss of coating material.

SUMMARY OF THE INVENTION

The present invention provides a method and apparatus for dross removal from a coating line comprising a coating pot for holding molten material having a bottom portion at or near which dross may accumulate, and a collection device for attracting and separating the dross from the molten material, wherein the collection device includes a magnetic field inducing element.

The present invention provides a dross removal system for coating lines comprising a coating pot for holding molten metal, for example zinc. Because bottom dross is continuously being generated in the molten material due to the coating process it is necessary to remove the bottom dross in order to produce a quality galvanized material. To this end, a first embodiment of the present invention utilizes a permanent or electromagnet to attract the dross and remove it from the molten material. Because the dross is magnetic and the molten material is not, the magnet provides an excellent device for separating the dross from the molten material without also removing the molten material. The magnet is placed into the coating pot and suspended therein. The magnet attracts the dross residing at or near the bottom of the pot. The magnet is periodically removed for cleaning. Using electromagnets allows turning the magnets on and off, allowing for easier cleaning.

In another embodiment a pump is coupled to the coating pot and continuously removes a combination of molten metal and dross particles from the coating pot and passes them onto a receiving area. The receiving area may be a settling container which includes a strong magnet or magnets in its bottom. As the molten metal and dross pass through the settling container the dross settles more quickly than the molten metal because it weighs approximately 10% more. Additionally, the dross particles are drawn to the magnets, creating even more separation between the dross particles and the molten metal. The remaining molten metal is returned to the coating pot or a premelter. The receiving area may also be a trough. In that case, a magnetic drum is positioned in close proximity to the molten metal in the trough. In one embodiment the magnetic drum is positioned such that at least a portion of the drum is submerged in the molten metal-dross combination which is pumped into the trough. In another embodiment, the magnetic drum is positioned above the trough but close enough to the molten metal to magnetically extract dross particles from the molten metal-dross combination. A conveyer belt is journaled about the drum. As the dross is attracted to the drum the conveyor belt carries the dross up and out of the trough and deposits the dross into a dross container positioned adjacent to the coating pot.

In another embodiment the dross is attracted to a magnetic element and conveyed up and out of the coating pot by a conveying system. The conveying system may be a multiphase solenoid coil wound about a tube that is placed into the coating pot. A sequential electrical dc current is applied to the coil windings beginning from the bottom and working upwards. A slow travelling wave is generated inside the tube. As the wave travels, it picks up magnetic dross particles and conveys them to the top of the tube. A constantly energized electromagnet is present at the top of the tube. As the dross material is conveyed upwards it is accumulated on the magnet. The magnet is periodically cleaned to remove the collected dross. The conveying system may also be a conveyor belt having a first end positioned at or near a bottom portion of the coating pot and a second end positioned above the molten metal. In that event, a magnetic plate is positioned abutting the conveyor belt on an interior side of the conveyor belt. The magnetic plate attracts the dross. As the dross is attracted to the magnetic plate the dross contacts the conveyor belt. The conveyor belt carries the attracted dross up and out of the coating pot and deposits the dross into a dross container positioned adjacent the coating pot.

DETAILED DESCRIPTION OF THE INVENTION

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
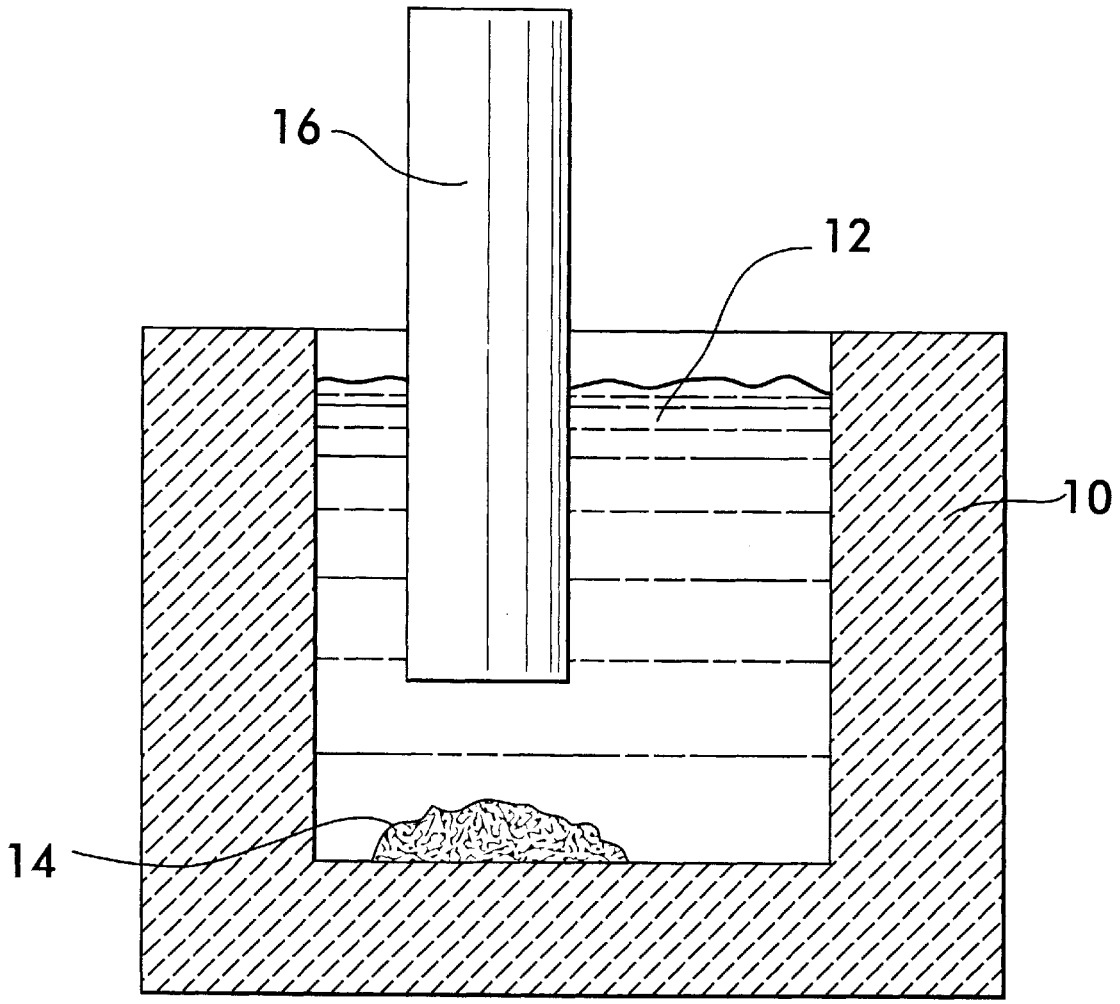
FIG. 1 is a cross-sectional view of a first embodiment of the present invention, greatly simplified.

Referring now to the drawings, wherein like numerals indicate like elements, there is shown in FIG. 1 a first embodiment of the present invention. The invention includes a coating pot 10 maintaining a non-magnetic molten material 12, for example zinc. Located at or near the bottom of the coating pot 10 is accumulated dross 14. The dross 14 accumulates over time due to interaction between the molten material 12 and workpieces (not shown) placed into and taken out of the molten material during the application. A magnet 16 is suspended in the coating pot 10 such that a first end of the magnet is positioned at or near the bottom of the coating pot 10. Magnet 16 may be either a permanent magnet or an electromagnet. An electromagnet may be turned on and off, thereby making cleaning easier. As the magnet 16 is suspended in the molten material 12, it attracts the finely dispersed magnetic dross 14. The magnet 16 will collect only the dross 14 and will not attract the non-magnetic molten material 12. The magnet 16 remains in the coating material 12 continuously except when it is periodically removed for cleaning.

Figure 2:
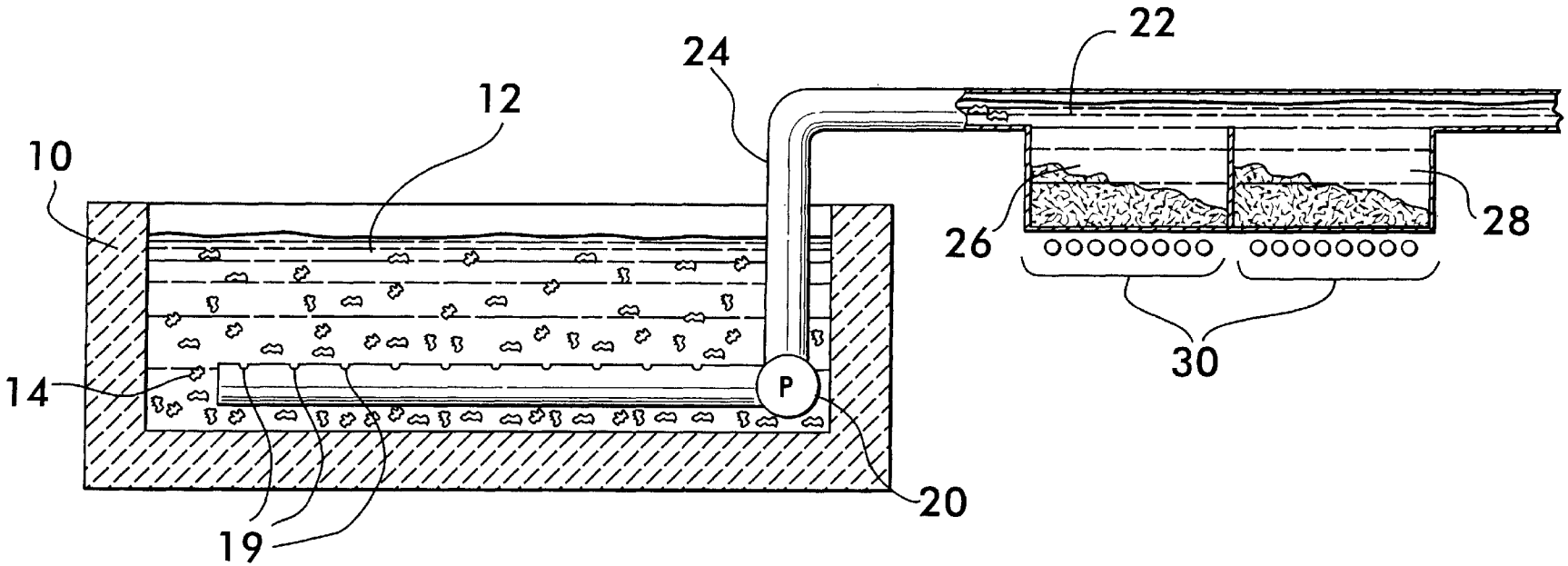
FIG. 2 is a cross-sectional view of a second embodiment of the present invention.

FIG. 2 illustrates a second embodiment of the present invention. This embodiment includes a coating pot 10 holding molten material 12. Suspended at or near the bottom of the coating pot is accumulated dross 14. This embodiment includes a tube 18 positioned at or near the bottom of the coating pot 10. The tube 18 includes inlets 19 providing an opening to the interior of the tube 18. The tube 18 is connected to a pump 20. The pump 20 draws material from the coating pot 10, including molten material 12 and dross 14 into the tube 18. The pump 20 conveys the removed material to a settling area 22 via a passage tube or launder 24. The settling area 22 provides one or more subsettling areas and in a preferred embodiment two subsettling areas 26 and 28. Each subsettling area 26 and 28 maintains a plurality of magnets 30 just below the bottom of the subsettling areas 26, 28. As the material removed from the coating pot 10 via pump 20 is conveyed to the settling area 22, the magnets 30 will attract the dross 14 to the bottom of the subsettling areas 26, 28 without attracting the molten material 12. This provides improved separation between the dross 14 and the molten material 12. The molten material which remains after separation is passed back to the coating pot 10 or into a molten bath (not shown).

Figure 3:
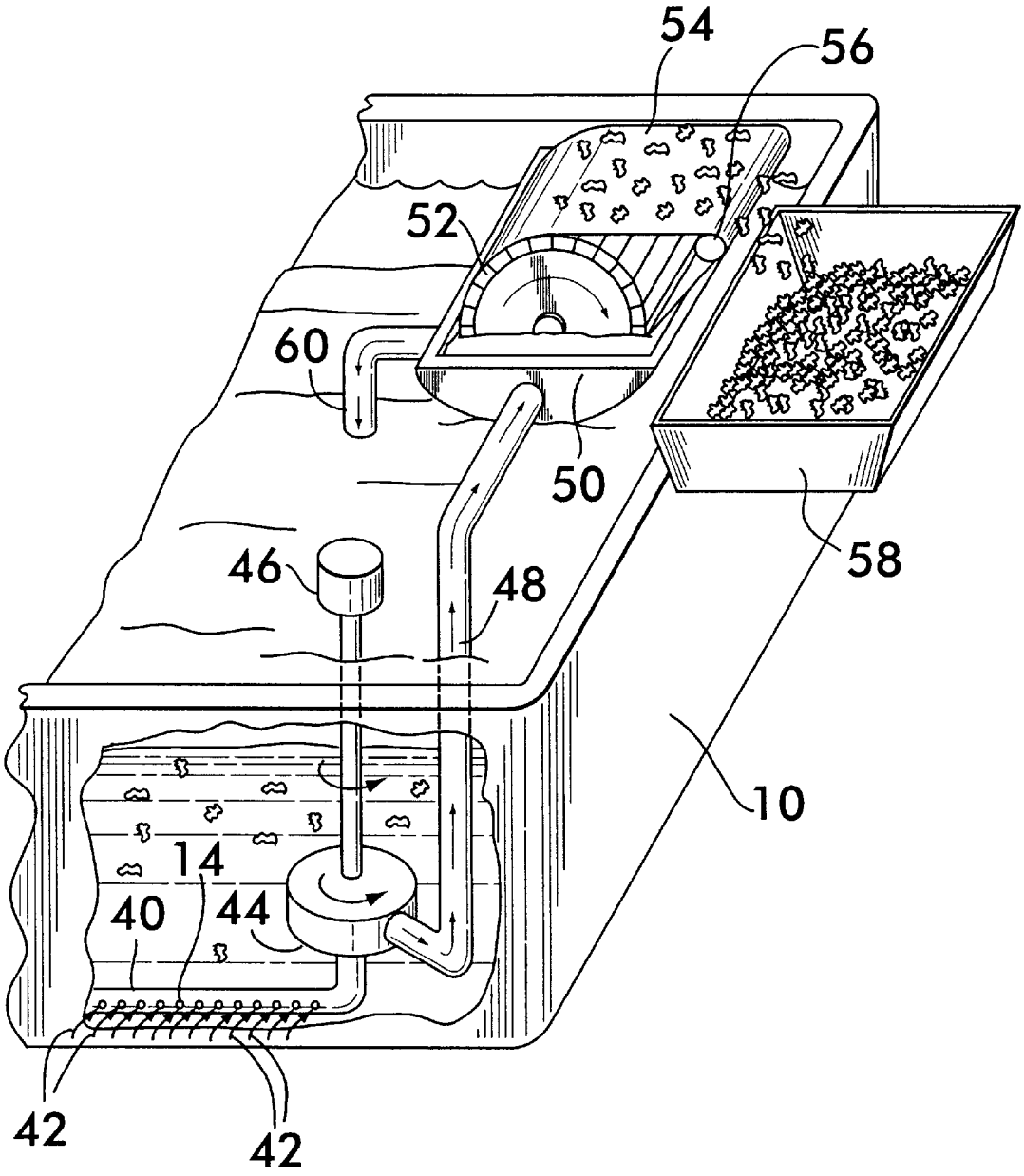
FIG. 3 is a perspective view of a third embodiment of the present invention.

A third embodiment of the present invention is illustrated in FIG. 3. This embodiment includes a coating pot 10 holding the molten material 12 wherein the dross has developed and accumulated in a suspension at or near the bottom of the coating pot 10. This embodiment further includes an inlet tube 40 having inlets 42. The inlets 42 allow a combination of the molten metal and the suspended dross 14 to enter the tube. The tube 40 is connected to a pump 44, which draws the molten metal-dross combination into the suction tube 40. The pump 44 is driven by a pump motor 46. Also connected to the pump 44 is an outlet tube 48. The molten metal-dross combination drawn into the tube 40 is forced into the tube 48 by the pump 44. The tube 48 carries the molten metal-dross combination up and out of the coating pot 10 and into a receiving trough 50. Associated with the receiving trough 50 is an electromagnetic drum 52 positioned in close and operative proximity to the trough 50. In one embodiment, a lower portion of the magnetic drum 52 resides within the trough 50 such that the lower portion of the magnetic drum 52 is submerged in the molten metal-dross combination once the pump 44 begins operation and forces the molten metal-dross combination into the trough 50. In another embodiment, the lower portion of the magnetic drum 52 is positioned above the molten metal-dross combination and the dross particles are extracted from the molten metal-dross combination by magnetic force supplied by the magnetic drum 52. An endless belt conveyor 54 operates with the magnetic drum 52 and an additional roller 56. The conveyor belt 54 may be made of stainless steel. A container 58 receives the dross which has been removed from the molten metal-dross combination by the system. The system further includes a return pipe 60 for returning the molten metal to the coating pot 10 once the dross 14 has been removed.

In operation the molten metal-dross combination is removed from the coating pot 10 by the pump 44. The molten metal-dross combination is received by the trough 50. When the magnetic drum 52 is energized it attracts the dross 14 from the molten metal-dross combination. As the drum rotates, as illustrated in FIG. 3, the conveyor belt 54 moves about the magnetic drum 52 and the additional roller 56. As the magnetic drum 52 rotates, the dross 14 is drawn to the conveyor belt 54 and held there by the magnetic field of the drum 52. As the conveyor belt 54 moves around the magnetic drum 52 it carries the dross 14 away from the magnetic drum 52 into the container 58. The purified molten metal is returned to the coating pot via return tube 60.

Figure 4:
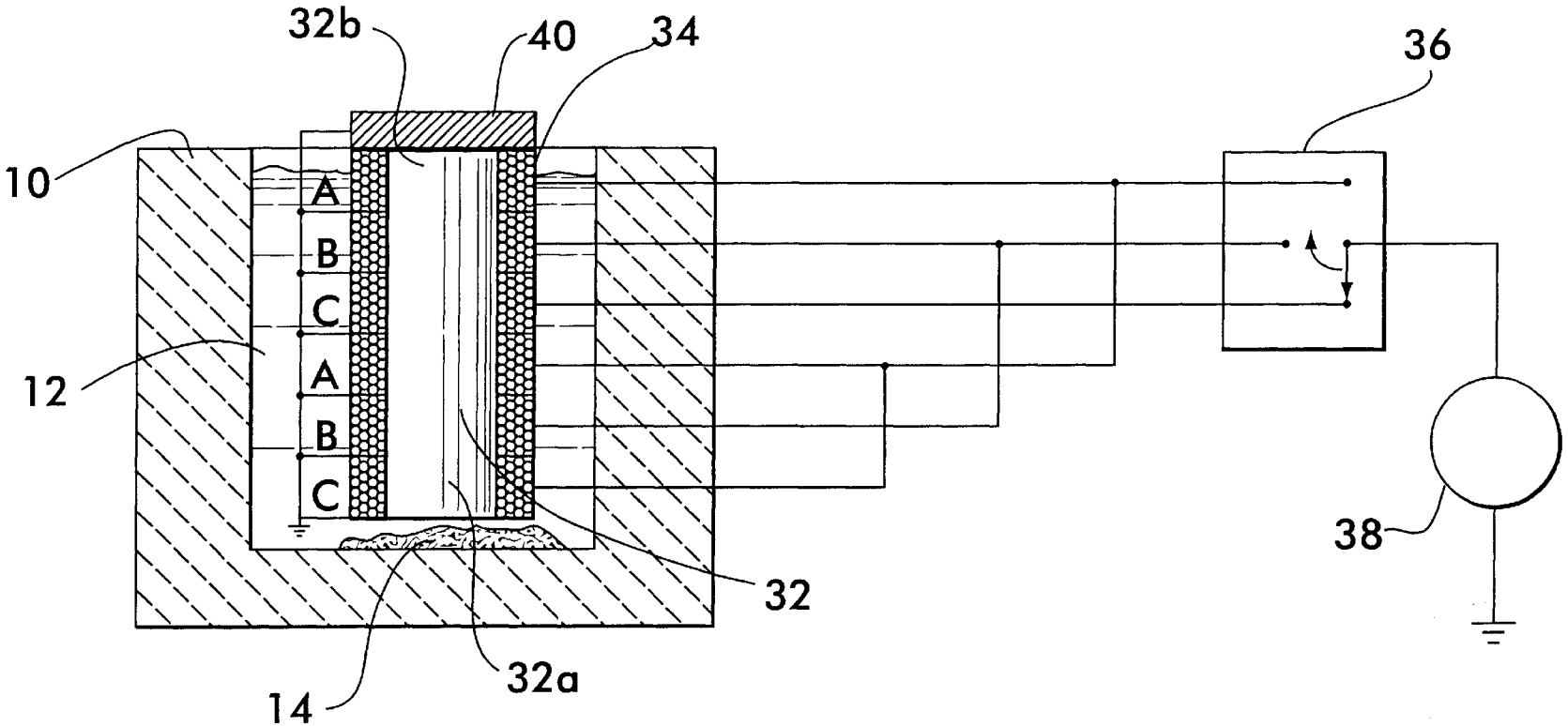
FIG. 4 is a cross-sectional view of a fourth embodiment of the present invention.

The fourth embodiment of the present invention is illustrated in FIG. 4. This embodiment includes a coating pot 10 holding the molten material 12 wherein dross 14 has developed and settled to the bottom of the coating pot 10. This embodiment further includes a tube 32 inserted into the coating pot 10 and molten material 12 such that a first end 32*a* of the tube is placed at or near the bottom of the coating pot 10 in close proximity to accumulated dross 14. A second end 32*b* of the tube is positioned just above the highest level of the molten material 12 providing a passage way from the bottom of the coating pot 10 to just above the molten material 12. Wound about the tube 32 is a multi-phase solenoid coil 34 extending from the first end 32*a* of the tube to the second end 32*b* of the tube. The coil 34 provides multiple sections as shown, for example, in FIG. 4 wherein the coil 34 includes groups A, B, and C. This embodiment is shown having six sections separated into three groups of two elements; however, it is not intended to limit the invention to three groups specifically. Each group A, B, and C is coupled to a switch 36. The switch 36 is positionable between contact points a, b, and c. Each contact point corresponds to one of the groups A, B, and C, respectively. When the switch 36 engages a particular one of the contact points a, b, or c the corresponding group A, B, or C is coupled to a power source 38. By successively switching between the three contact points the three magnetic groups A, B, and C are successively powered. This results in generating a slow travelling wave inside the tube 32. This wave will attract the magnetic dross 14 and urge it towards the top of the coating pot 10. As the dross 14 reaches the upper end of the tube 32*b* it will be accumulated on a constantly energized electromagnet 40 maintained at the top of tube 32. The magnet 40 will periodically be removed and cleaned in order to remove any collected dross 14.

Figure 5:
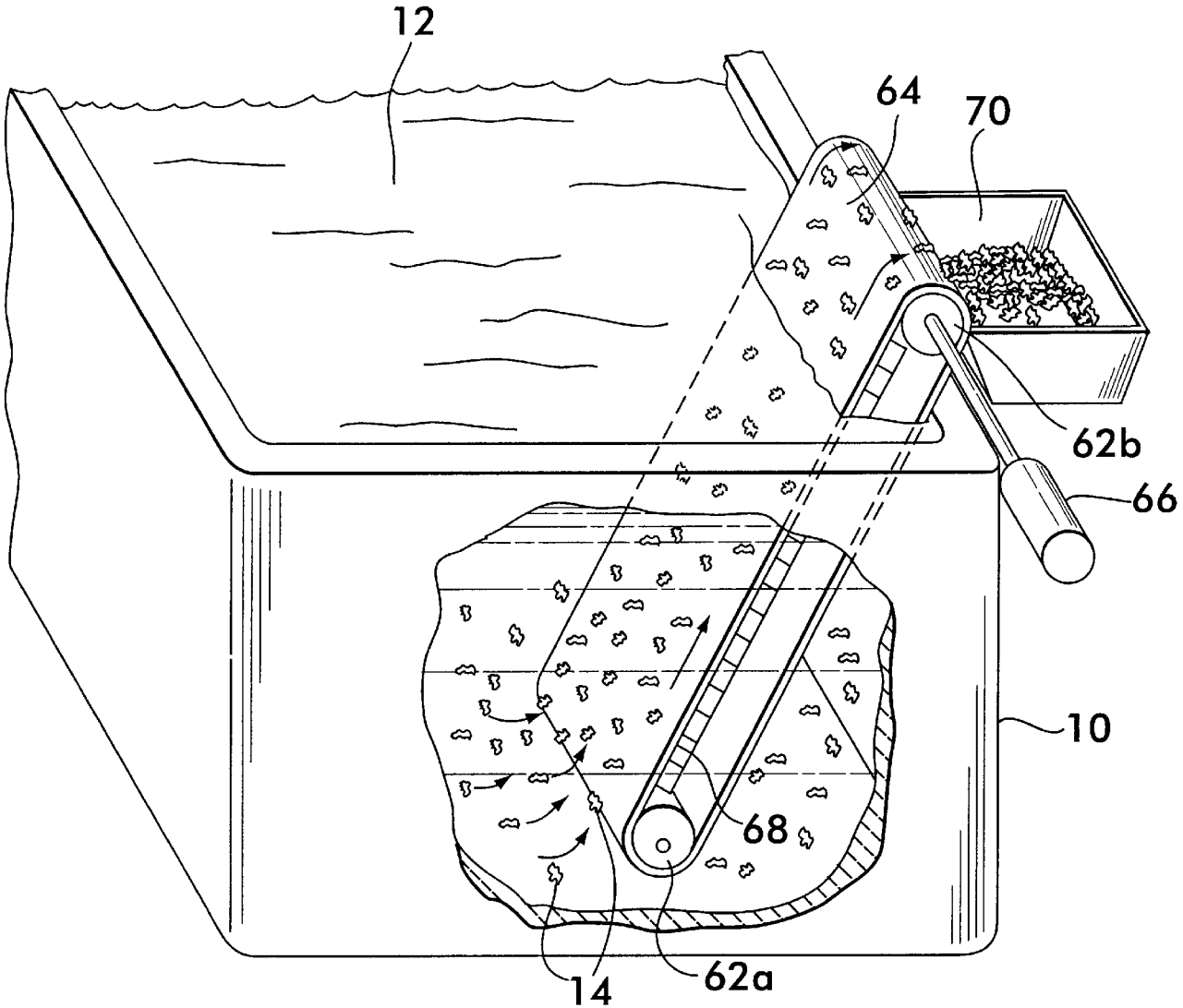
FIG. 5 is a perspective view of a fifth embodiment of the present invention.

A fifth embodiment of the present invention is illustrated in FIG. 5. This embodiment includes a coating pot 10 holding the molten material 12 wherein dross has developed in a suspension at or near the bottom of the coating pot 10. This embodiment further includes a pair of rollers 62*a*, 62*b*. The rollers 62*a*, 62*b* support a conveyor belt 64 and at least one roller is driven by a motor 66. The system also includes a magnetized plate 68 disposed between the rollers 62*a*, 62*b* and on an interior side of the conveyor belt 64. In operation, the motor 66 drives the rollers 62*a*, 62*b*, which in turn drive the conveyor belt 64. Because the plate 68 is magnetized, dross 14 suspended in the coating pot 10 is attracted to the plate 68. The magnetic field generated by the magnetic plate 68 holds the dross 14 against the conveyor belt 64 as the conveyor belt 64 moves up and out of the coating pot 10. As the conveyor belt 64 travels across the magnetic plate 68 the dross 14 is moved towards the top of the coating pot 10. Once the dross 14 reaches the top of the conveyor belt 64 about the upper pin 62*b* the dross 14 is then fed to a receiving container 70 which receives the dross 14 removed from the coating pot 10.

The present invention may be embodied in other specific forms without departing from the spirit or essential attributes thereof and, accordingly, reference should be made to the appended claims, rather than to the foregoing specification, as indicating the scope of the invention.

What is claimed is:

1. A dross removal system for removing dross from a coating line comprising:

a coating pot for holding molten metal, and having a bottom portion at or near which dross may accumulate;

an intake at or near the bottom portion of the pot extending from within the pot to outside the pot;

a pump coupled to the intake for pumping a molten metal-dross combination from the pot;

a receiving area for receiving the molten metal-dross combination pumped from the pot;

at least one magnet associated with and in close proximity to the receiving area, the magnet attracting the dross from the molten metal-dross combination for removal therefrom.

2. A dross removal system as claimed in claim 1, wherein the receiving area is a settling container for receiving the molten metal-dross combination and the magnet is housed in a bottom portion of the settling container, such that the magnet attracts the dross once the molten metal-dross combination enters the settling container.

3. A dross removal system as claimed in claim 1, wherein the receiving area is a trough for receiving the molten metal-dross combination and the magnet is a magnetic drum which is at least partially submerged in the molten metal-dross combination received in the trough.

4. A dross removal system as claimed in claim 3, further comprising a roller parallel to the magnetic drum, a conveyor belt movable around the roller and the magnetic drum for carrying the attracted dross out of the molten metal-dross combination, and a motor for driving the magnetic drum.

5. A dross removal system for coating lines comprising:

a coating pot maintaining a molten metal wherein dross accumulates at or near a bottom portion of the pot;

a tube submerged into the molten metal;

a series of coils sequentially wound about the tube;

a power supply circuit for applying a sequential dc current to each of the said series of coils; and an electromagnet located at the end of the tube at an upper portion of the coating pot, whereby the application of said sequential dc current creates a slow travelling wave inside the tube to attract and convey the dross up the tube and out of the pot for collection on the electromagnet.

6. A dross removal system for coating lines comprising:

a coating pot maintaining a molten metal wherein dross accumulates at or near a bottom portion of the pot;

a conveyor belt having a first end positioned at or near the bottom portion of the pot and a second end positioned above the molten metal; and a magnetic plate positioned on an interior side of the conveyor belt for attracting the dross, wherein the conveyor belt is adapted to travel across the magnetic plate from the bottom portion of the pot to above the molten metal and thereby carry the attracted dross out of the molten metal.

7. A method for removing dross from coating lines having a coating pot holding a molten metal and accumulated dross at or near a bottom portion of the coating pot comprising the steps of:

pumping a molten metal-dross combination from the coating pot;

transporting the removed molten metal-dross combination to a receiving area, the receiving area including at least one magnet associated with and in close proximity thereto;

magnetically attracting the dross from the molten metal-dross combination using the at least one magnet; and returning the molten metal which remains after the dross has been removed to the coating pot.

8. A method as claimed in claim 7, wherein the receiving area is a settling container including a settling area having at least one magnet in close proximity thereto and further comprising the step of allowing the dross to partially settle from the molten metal-dross combination to the settling area and attracting the dross with the at least one magnet.

9. A method as claimed in claim 7, wherein the receiving area is a trough, the magnet is a magnetic drum at least partially submerged in the molten metal-dross combination received in the trough.

10. A method as claimed in claim 9, further comprising the steps of driving a conveyor belt, by the magnetic drum, which travels about the magnetic drum into and out of the trough and carrying the attracted dross out of the trough.

11. A method for removing dross from coating lines having a coating pot holding a molten metal and accumulated at or near a bottom portion of the coating pot, comprising the steps of:

attracting the dross using a magnetic field inducing element and;

conveying attracted dross from the bottom portion of the coating pot up and out of the molten metal.

12. A method as claimed in claim 11, wherein the conveying step comprises the steps of:

inserting a tube into the molten metal such that a first end of the tube is maintained at or near the bottom portion of the coating pot and a second end of the tube is maintained at or near the molten metal surface level; and sequentially applying electric dc current to a multi-phase coil wound about the tube thereby generating a travelling wave inside the tube.

13. A method as claimed in claim 12, further comprising the step of accumulating the dross conveyed to an upper end of the coil on a magnet located adjacent the second end of the tube.

14. A method as claimed in claim 11, wherein the conveying step comprises the steps of:

positioning a conveyor belt having a first end at or near the bottom of the coating pot and a second end above the molten metal surface;

within the coating pot, attracting the dross with a magnetic plate positioned on an interior side of the conveyor belt; and carrying the attracted dross up and out of the molten metal on the conveyor belt.

* * * * *